US007866374B2

(12) United States Patent
Hou et al.

(10) Patent No.: US 7,866,374 B2
(45) Date of Patent: Jan. 11, 2011

(54) HEAT PIPE WITH CAPILLARY WICK

(75) Inventors: Chuen-Shu Hou, Tu-Cheng (TW); Tay-Jian Liu, Tu-Cheng (TW); Chao-Nien Tung, Tu-Cheng (TW); Chih-Hsien Sun, Tu-Cheng (TW)

(73) Assignee: Foxconn Technology Co., Ltd., Tucheng, Taipei County (TW)

( * ) Notice: Subject to any disclaimer, the term of this patent is extended or adjusted under 35 U.S.C. 154(b) by 1112 days.

(21) Appl. No.: 11/309,380

(22) Filed: Aug. 2, 2006

(65) Prior Publication Data

US 2007/0240857 A1 Oct. 18, 2007

(30) Foreign Application Priority Data

Apr. 14, 2006 (CN) ..... 2006 1 0060299

(51) Int. Cl.
*F28D 15/00* (2006.01)

(52) U.S. Cl. ..... 165/104.26; 165/104.21; 29/890.032

(58) Field of Classification Search ..... 165/104.11, 165/104.21, 104.26; 29/890.032
See application file for complete search history.

(56) References Cited

U.S. PATENT DOCUMENTS

| | | | | |
|---|---|---|---|---|
| 3,665,573 | A * | 5/1972 | Werner et al. | 165/104.26 |
| 3,884,296 | A * | 5/1975 | Basiulis | 165/104.26 |
| 3,901,311 | A | 8/1975 | Kosson et al. | |
| 4,004,441 | A | 1/1977 | Leszak | |
| 6,003,591 | A * | 12/1999 | Campbell | 165/104.26 |
| 6,209,200 | B1 * | 4/2001 | Campbell | 29/890.032 |
| 2001/0004934 | A1 * | 6/2001 | Yamamoto et al. | 165/104.11 |
| 2005/0077030 | A1 | 4/2005 | Wong | |
| 2007/0151709 | A1 * | 7/2007 | Touzov | 165/104.26 |

FOREIGN PATENT DOCUMENTS

| | | | |
|---|---|---|---|
| JP | 2002-62069 | A * | 2/2002 |
| SU | 870901 | A * | 10/1981 |
| SU | 1060915 | A * | 12/1983 |
| SU | 1108324 | A * | 8/1984 |
| SU | 1111016 | A * | 8/1984 |
| SU | 1198365 | A * | 12/1985 |
| SU | 1237890 | A * | 6/1986 |
| TW | 589444 | | 6/2004 |
| WO | WO 03/019098 | * | 3/2003 |

* cited by examiner

*Primary Examiner*—Ljiljana (Lil) V Ciric
(74) *Attorney, Agent, or Firm*—Jeffrey T. Knapp

(57) ABSTRACT

A heat pipe includes a cylinder-shaped casing (100) containing a working fluid therein and a capillary wick (200) arranged on an inner wall of the casing. The capillary wick encloses a vapor passage (300) in a center of the casing. The capillary wick includes a plurality of shaped foils stacked on the inner wall of the casing along a radial direction thereof. The foils are sintered to the inner wall of the casing and define a multi-channel structure for the working fluid to flow from a condensing section to an evaporating section of the heat pipe.

6 Claims, 7 Drawing Sheets

(a)

(b)

(c)

HEAT PIPE WITH CAPILLARY WICK

FIELD OF THE INVENTION

The present invention relates generally to apparatus for transfer or dissipation of heat from heat-generating components such as electronic components, and more particularly to a heat pipe having a capillary wick with a multiple micro-channel structure.

DESCRIPTION OF RELATED ART

Heat pipes have excellent heat transfer properties, and therefore are an effective means for transfer or dissipation of heat from heat sources. Currently, heat pipes are widely used for removing heat from heat-generating components such as central processing units (CPUs) of computers. A heat pipe is usually a vacuum casing containing a working fluid therein, which is employed to carry, under phase transitions between liquid state and vapor state, thermal energy from one section of the heat pipe (typically referred to as "evaporating section") to another section thereof (typically referred to as "condensing section"). Preferably, a wick structure is provided inside the heat pipe, lining an inner wall of the casing, for drawing the working fluid back to the evaporating section after the working fluid is condensed at the condensing section. Specifically, as the evaporating section of the heat pipe is maintained in thermal contact with a heat-generating component, the working fluid contained at the evaporating section absorbs heat generated by the heat-generating component and then turns into vapor. As a result, due to the difference of vapor pressure between the two sections of the heat pipe, the vapor moves towards and carries the heat simultaneously to the condensing section where the vapor is condensed into liquid after releasing the heat into ambient environment by, for example, fins thermally contacting the condensing section, and the heat is then dispersed. Due to the difference of capillary pressure developed by the wick structure between the two sections, the condensed liquid is then drawn back by the wick structure to the evaporating section where it is again available for evaporation.

The wick structure currently available for heat pipes includes fine grooves integrally formed at the inner wall of the casing, screen mesh or bundles of fiber inserted into the casing and held against the inner wall thereof, or sintered powder combined to the inner wall of the casing by sintering process. Among these wicks, the sintered powder wick is preferred to the other wicks with respect to heat transfer ability and ability against gravity of the earth.

In a heat pipe, the primary function of a wick is to draw the condensed liquid back to the evaporating section of the heat pipe under the capillary pressure developed by the wick. Thus, the capillary pressure has become an important parameter to evaluate the performance of the wick. Since it is well recognized that the capillary pressure of a wick increases due to a decrease in pore size of the wick, the sintered powder wick generally has a capillary pressure larger than that of the other wicks due to its very dense structure of small particles. Although the sintered powder wick has the advantage of larger capillary pressure, it has a drawback that it retards heat transmission from the heats source to the working fluid in the evaporating section, and from the working fluid in the condensing section to the fins due to the compactness of the sintered powder wick. Moreover, it is difficult to obtain the sintered powder wicks in the course of mass production of the heat pipes with uniform quality, since the pore ratios and the pore sizes of the sintered powder wicks are difficultly to control.

Therefore, it is desirable to provide a heat pipe with a wick that can overcome the disadvantages of the sintered powder wick while maintaining the advantages thereof.

SUMMARY OF THE INVENTION

A heat pipe in accordance with a preferred embodiment of the present invention includes a casing containing a working fluid therein and a capillary wick arranged on an inner wall of the casing. The capillary wick encloses a vapor passage in a center of the casing. The capillary wick includes a plurality of shaped foils stacked along a radial direction of the casing, wherein a multi-channel structure for the working fluid to flow from a condensing section to an evaporating section of the heat pipe is formed in the stacked foils.

Other advantages and novel features of the present invention will become more apparent from the following detailed description of preferred embodiment when taken in conjunction with the accompanying drawings, in which:

BRIEF DESCRIPTION OF THE DRAWINGS

Many aspects of the present apparatus and method can be better understood with reference to the following drawings. The components in the drawings are not necessarily drawn to scale, the emphasis instead being placed upon clearly illustrating the principles of the present apparatus and method. Moreover, in the drawings, like reference numerals designate corresponding parts throughout the several views.

DETAILED DESCRIPTION OF THE INVENTION

Figure 1:
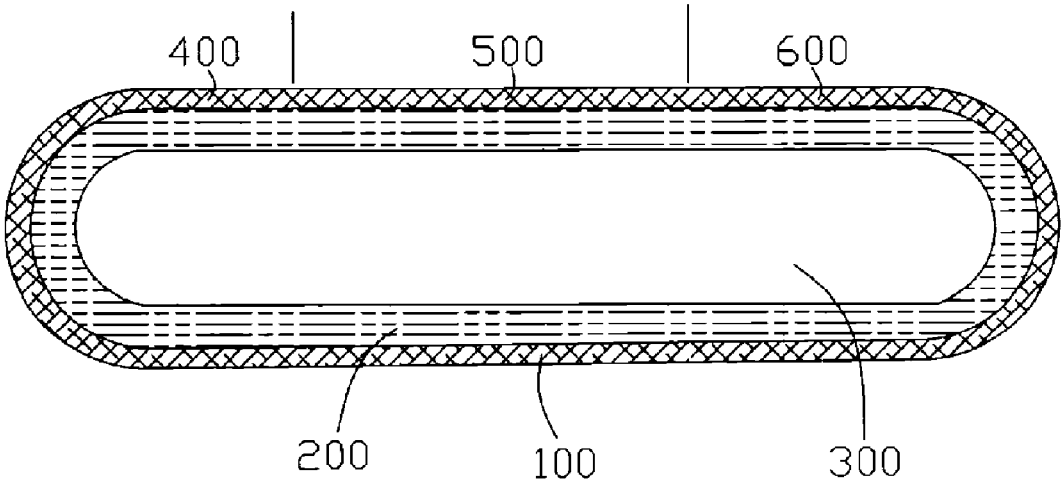
FIG. 1 is a longitudinally cross-sectional view of a heat pipe in accordance with the present invention.

FIG. 1 illustrates a heat pipe in accordance with the present invention. The heat pipe comprises a casing 100 and a capillary wick 200 arranged on an inner wall of the casing 100. A column-shaped vapor passage 300 is enclosed by an inner surface of the capillary wick 200 and located in a center of the casing 100. The casing 100 comprises an evaporating section 400 at an end thereof, a condensing section 600 at an opposite end thereof, and an adiabatic section 500 located between the evaporating section 400 and the condensing section 600. The casing 100 has a column-shaped configuration and typically is made of highly thermally conductive materials such as copper or copper alloys. The casing 100 is filled with a working fluid (not shown) therein, which acts as a heat carrier for carrying thermal energy from the evaporating section 400 toward the condensing section 600 via the vapor passage 300 when undergoing a phase transition from liquid state to vapor-ous state. In more detail, heat that needs to be dissipated is transferred firstly to the evaporating section 400 of the casing 100 to cause the working fluid to evaporate. Then, the heat is carried by the working fluid in the form of vapor to the condensing section 600 where the heat is released to ambient environment via fins (not shown) attached to the condensing section 600; thus, the working fluid condenses into liquid. The condensed liquid is then brought back, via the capillary wick 200, to the evaporating section 400 where it is again available for evaporation.

Figure 2:
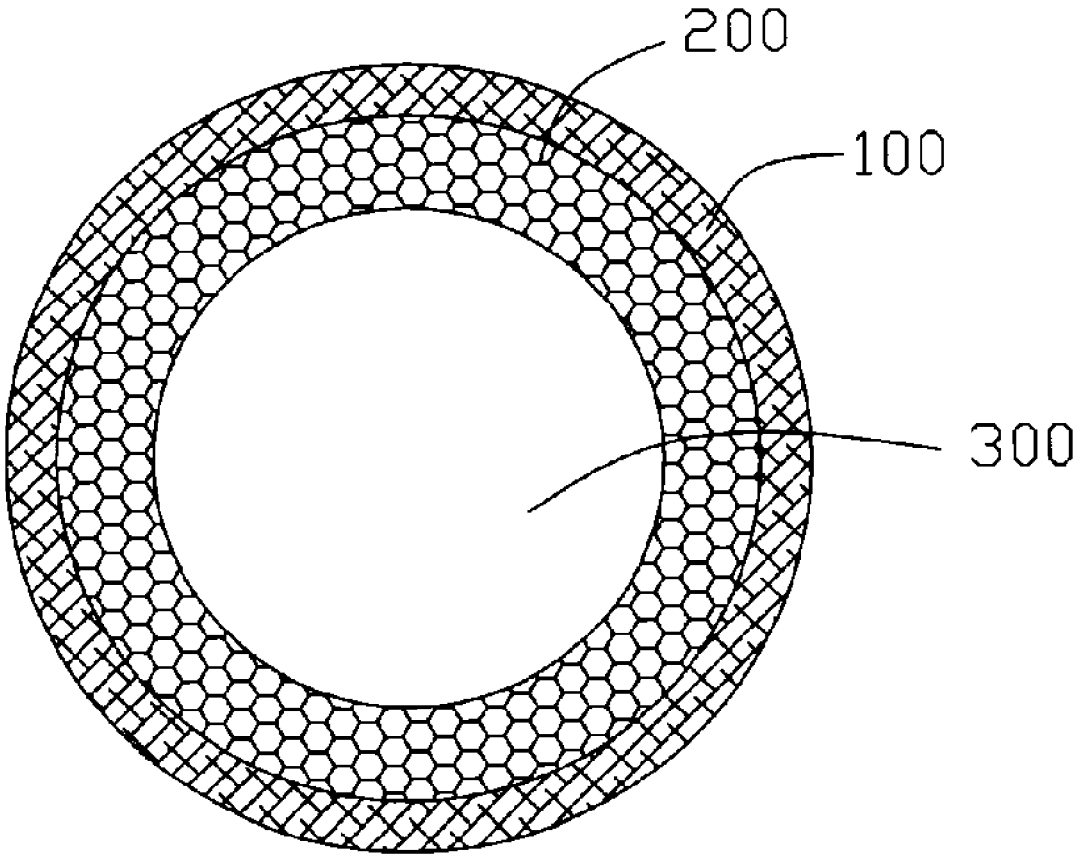
FIG. 2 is a transversely cross-sectional view of the heat pipe of FIG. 1.

The capillary wick 200 has a multi-channel structure along a longitudinal direction of the casing 100. The capillary wick 200 comprises multiple foils stacked together along a radial direction of the casing 100. An outer foil engages an inner surface of the casing 100. Referring to FIG. 2, along the radial direction of the casing 100, the capillary wick 200 has a beehive-shaped structure with a high pore ratio. In the present invention, the foils preferably are metal foils.

Figure 3:
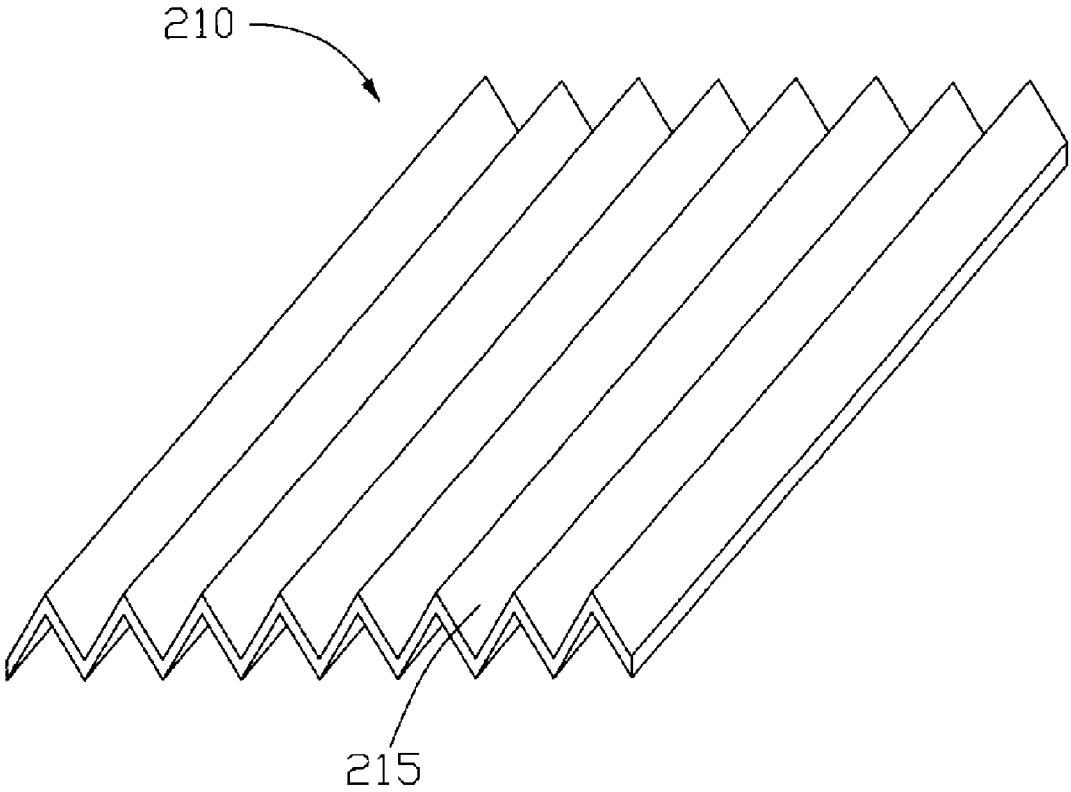
FIG. 3 is a first sample of a foil used to form a capillary wick arranged in the heat pipe of FIG. 1.
Figure 4:
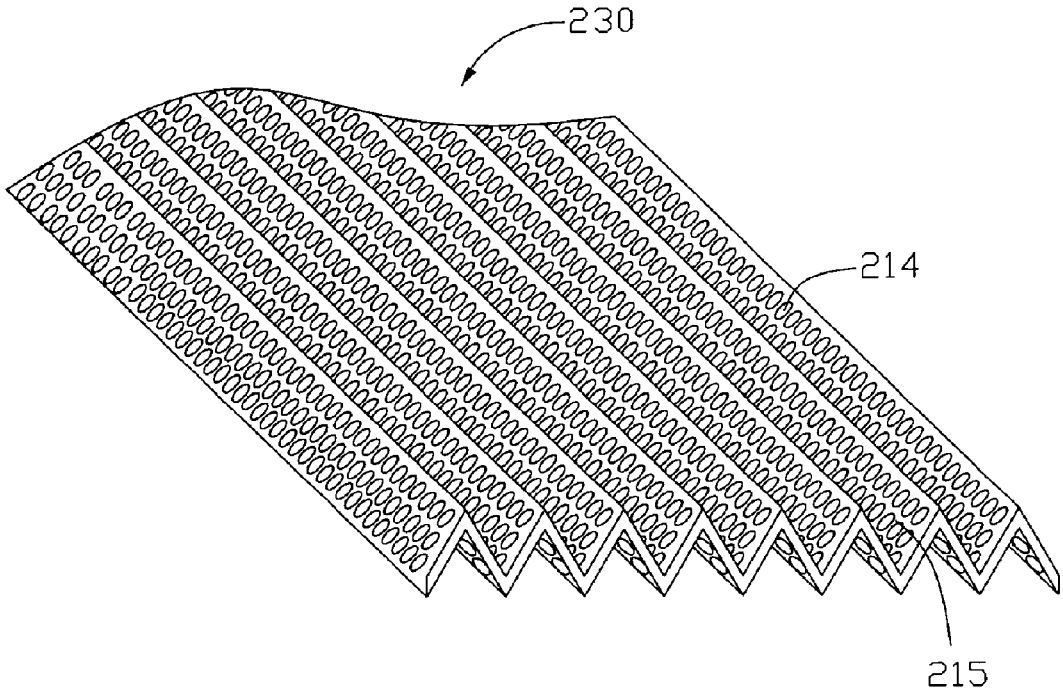
FIG. 4 is a second sample of a foil used to form the capillary wick arranged in the heat pipe of FIG. 1.

Referring to FIG. 3, a first sample of a foil 210 for forming the capillary wick 200 is shown. The foil 210 is formed to have a serrated profile. A plurality of channels 215 is formed by the foil 210 in upper and lower surfaces thereof. When a number of the foil 210 is stacked together radially on the inner surface of the casing 100 to form the capillary wick 200, the channels 215 form the multi-channel structure of the capillary wick 200 for drawing liquid from the condensing section 600 to the evaporating section 400. Referring to FIG. 4, a second sample of a foil 230 for forming the capillary wick 200 is shown. A main difference between the first and second foils 210, 230 is in that the second foil 230 defines a plurality of pores 214 therein, but the first foil 210 does not have any pore therein. When a number of the foil 230 is stacked together radially on the inner surface of the casing 100 to form the capillary wick 200, not only the channels 215 but also the pores 214 form the multi-channel structure of the capillary wick 200 for drawing the condensed liquid from the condensing section 600 back to the evaporating section 400. The multi-channels constructed by the second sample of foil 230 are labyrinthian, in comparison with the multi-channels constructed by the first sample of foil 210, whereby the condensed liquid can take more paths to return to the evaporating section 400 from the condensing section 600 when the capillary wick 200 is formed by the second foil 213. Accordingly, the second sample of foil 230 can more effectively prevent and solve the problem of dry out of the heat pipe in comparison with the first sample of foil 210. The dry out problem is that the condensed liquid cannot be timely drawn back to the evaporating section 400 from the condensing section 600 for a next thermal circulation.

Figure 5:
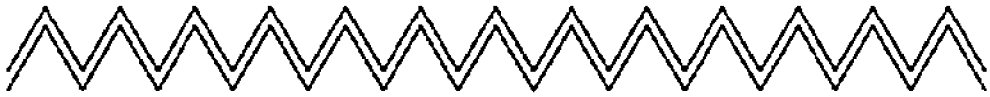
FIG. 5 shows three cross-sectional views that the foils can be shaped.
Figure 5:
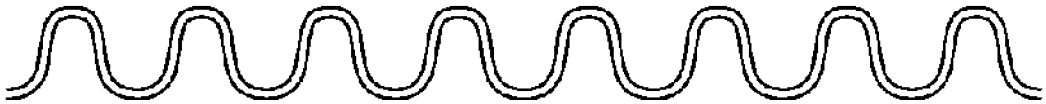
Figure 5:
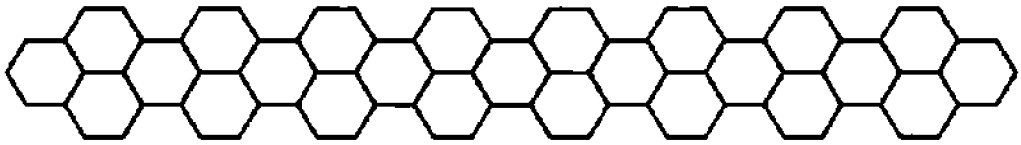

FIGS. 5 (*a*)-(*c*) illustrate cross-sectional views of three profiles that the foil can take. FIG. 5(*a*) shows the serrated profile like that shown in FIGS. 3 and 4. FIG. 5(*b*) shows that the profile has a wave-like shape. FIG. 5(*c*) shows that the profile has a beehive-like shape.

Figure 6:
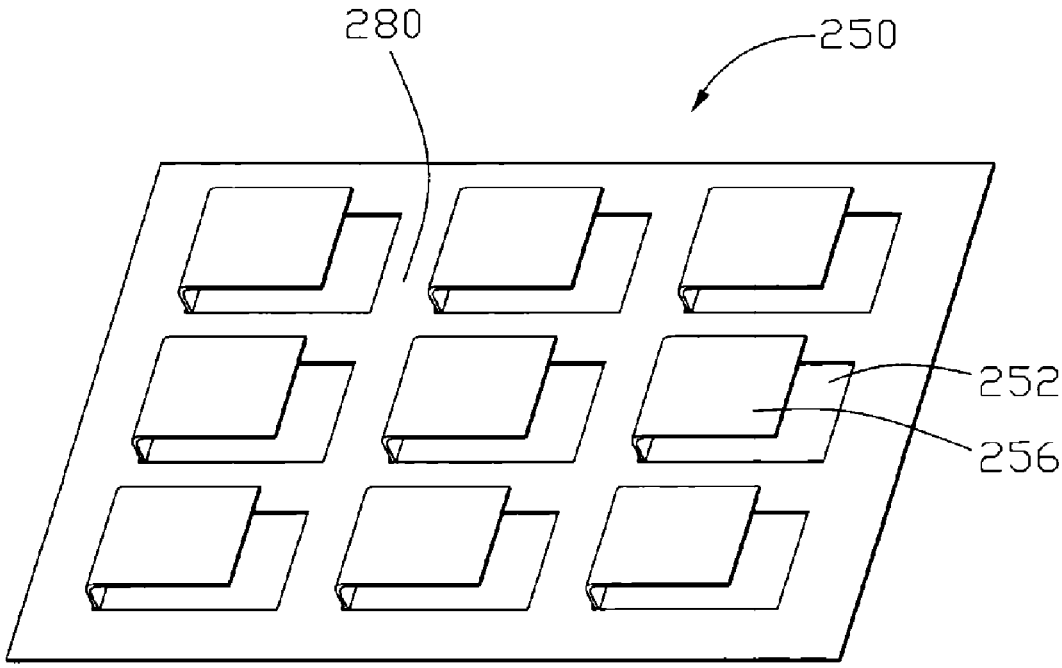
FIG. 6 is a third sample of a foil used to form the capillary wick arranged in the heat pipe of FIG. 1.

Referring to FIG. 6, a third sample of a foil 250 for forming the capillary wick 200 is shown. The foil 250 comprises a plurality of rectangular protruding portions 256 extending from a surface of a body (not labeled) of the foil 250. Each of the protruding portions 256 has only one side connecting with the body (not labeled) of the foil 250. A plurality of rectangular pores 252 is defined in the body of the foil 250 below the protruding portions 256, respectively. The protruding portions 256 are arranged in a matrix so that a plurality of perpendicular micro-channels 280 is formed between the protruding portions 256. The multi-channel structure of the capillary wick 200 can be achieved by the micro-channels 280 of the foil 250 and the rectangular pores 252. Each of the rectangular pores 252 is communicated with corresponding micro-channels 280 through three sides of a space between the protruding portion 256 and the rectangular pore 252, whereby the condensed liquid can flow through not only the micro-channels 280 but also the rectangular pores 252 to reach the evaporating section 400 from the condensing section 600 of the heat pipe.

Figure 7:
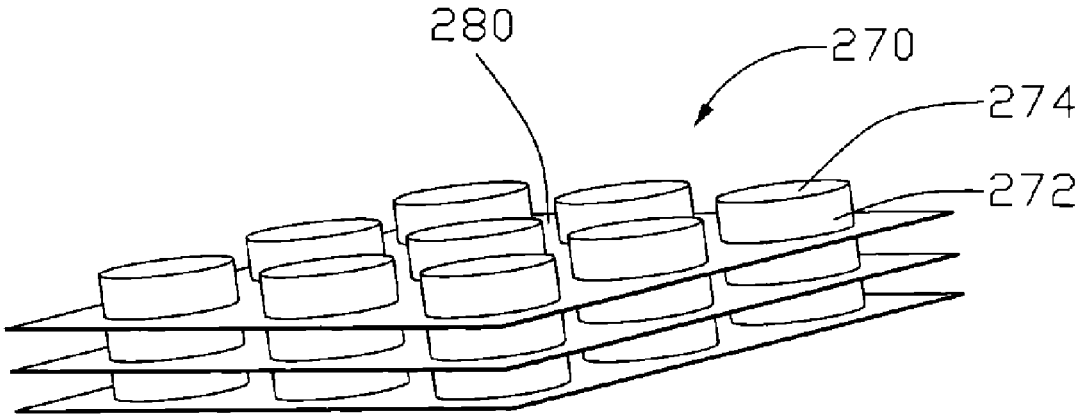
FIG. 7 is a fourth sample of a foil used to form the capillary wick arranged in the heat pipe of FIG. 1.

Referring to FIG. 7, a fourth sample of a foil 270 for forming the capillary wick 200 is shown. The foil 270 comprises a plurality of hollow cylinders 272 extending upwardly from a body (not labeled) of the foil 270. Each hollow cylinder 272 defines a round pore 274 in a center of the cylinder 272. The hollow cylinders 272 are arranged on the body of the foil 270 in a matrix. A plurality of perpendicular micro-channels 280 is formed between the hollow cylinders 272. The multi-channel structure of the capillary wick 200 can be achieved by the micro-channels 280 between the hollow cylinders 272 of the foil 270 and the round pores 274 defined in the hollow cylinders 272.

In practice, the capillary wick 200 can be made by the foils 210, 230, 250, 270 individually, or any combination thereof. Furthermore, a flat foil (not shown) can be interposed between any two shaped foils 210, 230, 250, 270.

Size of the micro-channels of the capillary wick 200 can be accurately controlled by controlling shapes, sizes and stacked density of the foils in manufacturing the capillary wick 200 so as to achieve an optimal capillary pressure. Generally, the more foils that the capillary wick 200 contains, the larger capillary pressure the capillary wick 200 can generate; nevertheless, by modulating the sizes of the channels 215, 280 and the pores 214, 252, 274, the capillary pressure and the heat transmission of the working fluid of the heat pipe at the evaporating section 400 and the condensing section 600 can be adjusted to be optimal for the specific application.

In the present invention, the heat pipe with the capillary wick 200 can be manufactured by using the method as mentioned below. First of all, the foils 210, 230, 250, 270 are wrapped around a mandrel (not shown). The mandrel is used to hold the foils 210, 230, 250, 270 in place. Then, the mandrel is inserted into a hollow metal tube (not shown) for forming the casing 100, whereby the wrapped foils 210, 230, 250, 270 are compressed between the mandrel and an inner surface of the metal tube. The hollow metal tube has one end being sealed. Next, the metal tube with the mandrel and the wrapped foils is placed into an oven and is heated under a high temperature to cause the foils to be sintered to the hollow metal tube. After this sintering step, the mandrel is drawn out of the hollow metal tube and a working fluid such as water, alcohol, methanol, or the like, is injected into the hollow metal tube through an open end of the hollow metal tube. Finally, the hollow metal tube is vacuumed and the open end of the hollow metal tube is hermetically sealed so as to form the heat pipe with the powder wick 200 arranged therein.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heat pipe comprising:

a cylinder-shaped metal casing containing a working fluid therein, the casing comprising an evaporating section and a condensing section at opposite ends thereof, respectively, and an adiabatic section located between the evaporating section and the condensing section; and a capillary wick arranged on an inner wall of the casing, an inner surface of the capillary wick forming a vapor passage extending along a longitudinal direction of the casing;

wherein the capillary wick comprises a plurality of shaped foils stacked along a radial direction of the metal casing, each shaped foil defines multiple channels therein for the working fluid to flow from the condensing section to the evaporating section through the adiabatic section, at least one of the foils has a plurality of protruding portions extending from a surface thereof, the protruding portions are spaced from each other, each of the protruding portions has only one side connecting the corresponding surface of the at least one foil, and a plurality of pores is defined in the at least one foil below the protruding portions, respectively.

2. The heat pipe of claim 1, wherein a plurality of micro channels is defined between the protruding portions, the multiple channels are formed by the micro channels and the pores defined in the at least one of the foils.

3. A heat pipe comprising:

a cylinder-shaped, metal casing containing a working fluid therein, the casing comprising an evaporating section, a condensing section and an adiabatic section between the evaporating section and condensing section; and a capillary wick attached to an inner wall of casing, the capillary wick enclosing a vapor passage in a center of the casing and extending along a longitudinal direction of the casing, the capillary wick comprising a plurality of foils sintered to the inner wall of the casing, the sintered foils defining a plurality of channels therein for the working fluid to flow from the condensing section to the evaporating section via the adiabatic section;

wherein at least one of the foils has a plurality of protruding portions extending from a surface thereof, the protruding portions are spaced from each other, each of the protruding portions has only one side connecting the corresponding surface of the at least one foil, and a plurality of pores is defined in the at least one foil below the protruding portions, respectively.

4. The heat pipe of claim 3, wherein the protruding portions are arranged in a matrix.

5. The heat pipe of claim 4, wherein each of the protruding portions is a rectangular plate.

6. The heat pipe of claim 3, wherein a plurality of micro channels is defined between the protruding portions, and the channels are formed by the micro channels and the pores.

* * * * *